US005360264A

United States Patent [19]

Crane

[11] Patent Number: 5,360,264

[45] Date of Patent: Nov. 1, 1994

[54] VERSATILE CHILDREN'S PLAY TABLE WITH TOY STORAGE

[76] Inventor: Michael N. Crane, 12932 W. 105th Ter., Overland Park, Kans. 66215

[21] Appl. No.: 16,295

[22] Filed: Feb. 11, 1993

[51] Int. Cl.[5] ..... A47B 77/18; A47B 85/00

[52] U.S. Cl. ..... 312/293.1; 312/204; 108/13; 108/90; 108/149

[58] Field of Search ..... 312/204, 265.6, 330.1, 312/293.1; 108/11, 13–14, 90, 149

[56] References Cited

U.S. PATENT DOCUMENTS

| | | | |
|---|---|---|---|
| 715,055 | 12/1902 | Greenlaw et al. | 108/13 |
| 1,850,420 | 3/1932 | Schuldt | 311/106 |
| 2,003,834 | 6/1935 | Mitchell | 108/90 |
| 2,008,613 | 7/1935 | Hernes | 108/90 |
| 2,903,312 | 9/1959 | Lawless | 108/13 X |
| 3,227,105 | 1/1966 | Reisdorff et al. | 108/13 |
| 3,688,707 | 9/1972 | White | 108/90 X |
| 3,806,220 | 4/1974 | Payne | 312/330 |
| 3,926,488 | 12/1975 | Amos | 312/204 X |
| 4,872,410 | 10/1989 | Lilly | 108/26 |
| 5,055,081 | 10/1991 | Nayak | 446/75 |
| 5,218,912 | 6/1993 | Buske | 108/14 X |

FOREIGN PATENT DOCUMENTS

| | | | |
|---|---|---|---|
| 752741 | of 1933 | France | 108/13 |
| 2248670 | 5/1975 | France | 108/13 |

*Primary Examiner*—Kenneth J. Dorner
*Assistant Examiner*—Nancy Mulcare
*Attorney, Agent, or Firm*—Litman, McMahon & Brown

[57] ABSTRACT

A versatile child's play table includes a removable and reversible table top with a smooth playing surface on one side and a modular building block interconnection system on the other side. The reversible table top can be removed to reveal a recessed playing surface with a surrounding ledge. Attached beneath the recessed playing surface are one or more toy storage drawers, and beneath the drawer(s) is a storage area with supports for storing the reversible table top. In an alternative embodiment, the reversible table top is formed from two halves, each of which are independently removable and reversible.

23 Claims, 2 Drawing Sheets

VERSATILE CHILDREN'S PLAY TABLE WITH TOY STORAGE

BACKGROUND OF THE INVENTION

I. Field of The Invention

The present invention relates to a children's play table, and more specifically to such a play table which includes a removable and reversible table top. One side of the reversible table top incorporates a plurality of interlocking elements for a modular building system while the reverse side is a smooth work surface. Beneath the reversible table top is a recessed work surface which is exposed when the reversible table top is removed. Beneath the recessed surface is a storage area which can accommodate a number of drawers for toy storage with an area beneath the drawers which includes supports for the reversible table top.

II. Description of The Related Art

As anyone who has been a parent or who has otherwise worked with young children can attest, it is important to provide a location where toys can be stored, but in which they remain conveniently accessible to children. This is particularly true of toys which comprise a number of small pieces, such as modular building block systems, puzzles, games, etc. At the same time, the use of such toys requires a firm play surface which is provided at a height which children can easily reach. It would be helpful if the play surface could be used both for building block construction and other activities as well, which would mean that any interlocking elements on the work surface must be capable of being covered or removed.

Previous attempts to design a versatile children's play table have included U.S. Pat. No. 1,850,420 to Schuldt, in which a removable, reversible table top has a pattern on one side for checkers or chess and on the other side for backgammon. U.S. Pat. No. 3,806,220 to Payne teaches a desk with a removable plastic storage tray which operates along rails beneath the desk top. U.S. Pat. No. 4,872,410 to Lilly teaches a foldable playtray which includes a modular building block surface on one side and a smooth surface on the reverse side. The legs can be rotated to support the table or to be coplanar with and extend the table surface. Small objects can also be stored in the legs. Finally, U.S. Pat. No. 5,055,081 to Nayak teaches a play table in which a table surface has a modular building block surface with a centrally located opening to a storage container beneath the surface. An optional flat panel can be placed over the building block surface to make a smooth playing surface.

Despite these earlier tables, a need still exists for a versatile children's play table equipped for play with a modular building block system. Such a play table should have conveniently accessible storage for a large number of building blocks or other toys and games, should have a removable and reversible top which is convertible between a smooth surface and a modular building block surface, and should provide storage space within the table for the convertible top when it is removed.

SUMMARY OF THE INVENTION

The present invention is a versatile children's play table including a removable and reversible table top with a first side which incorporates a plurality of modular building block interlocking elements. The reverse side of the reversible table top is a smooth play surface. A further, recessed play surface is arranged beneath the reversible table top. A ledge surrounds the recessed play surface after the reversible table top is removed. One or more storage drawers are arranged beneath the recessed play surface, and there is space beneath the drawer(s) to store the removed, reversible table top. In a second embodiment, the reversible table top is split, so that each half of the table top is independently removable and reversible. With this arrangement, one half of the table top can have the smooth side facing upward, for example, while the other half has the modular building block elements facing upward. Alternatively, one half of the table top can be removed, exposing the recessed play surface under only the removed half of the reversible table top.

OBJECTS AND ADVANTAGES OF THE INVENTION

The principle objects and advantages of the invention include: to provide an improved children's play table; to provide such a table which includes a removable and reversible table top; to provide such a table in which the reversible table top includes a smooth play surface on one side and a modular building block interlocking surface on the reverse side; to provide such a table which includes a further, recessed play surface beneath the reversible table top, which recessed surface is exposed when the reversible table top is removed; to provide a ledge surrounding the recessed play surface so that toys are retained on the recessed play surface; to provide one or more toy storage drawers beneath the recessed play surface; to provide a storage area beneath the storage drawer(s) which includes supports for storing the reversible table top when it is removed; to provide an alternative embodiment of such a table in which the removable and reversible table top is split in half, with each half independently removable and reversible; and to provide such a table which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
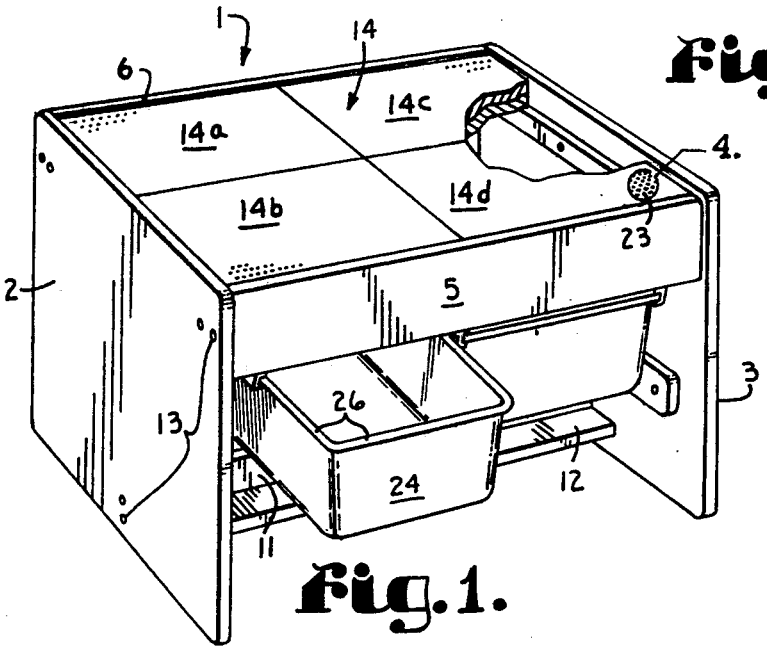
FIG. 1 is a perspective view of a versatile children's play table in accordance with the present invention.
Figure 4:
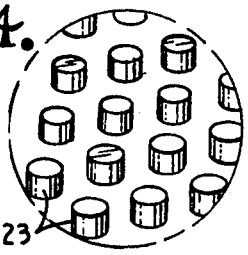
FIG. 4 is a fragmentary, enlarged portion of the play table labeled 4 in FIG. 1, showing the highlighted area of the reversible table top magnified to illustrate the modular building block interlocking components.
Figure 2:
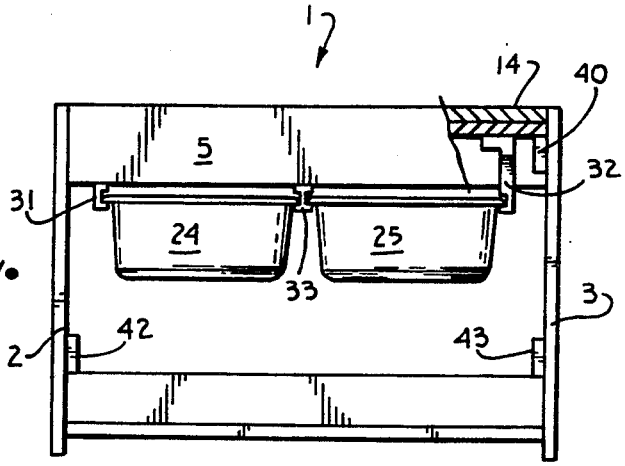
FIG. 2 is a front elevational view of the play table, with a pair of storage tubs inserted into corresponding pairs of drawer holding slots.
Figure 3:
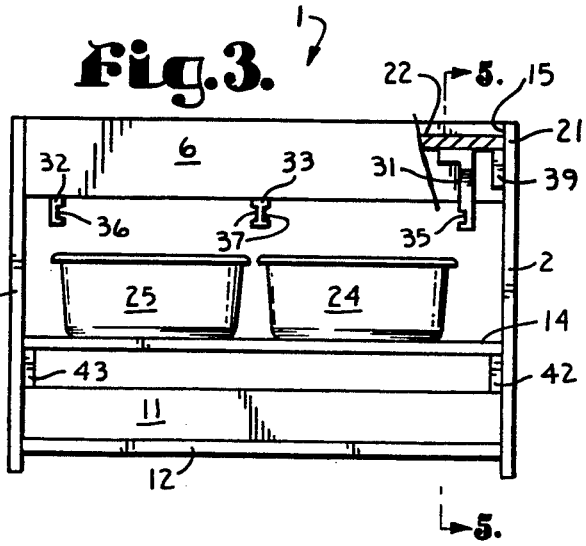
FIG. 3 is a rear elevational view of the play table, with the pair of storage tubs removed from the corresponding pairs of drawer holding slots and placed on the stored reversible table top.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–7, the numeral 1 generally designates a versatile children's play table. The table 1 comprises a pair of side supports 2 and 3 which are connected by front and rear frame members 5 and 6 and rigidizing frame members 11 and 12. The frame members 11 and 12 are connected such that their cross-section forms a T. The side supports 2 and 3, and the frame members 5, 6, 11 and 12 are connected to each other by a plurality of screws 13.

The table 1 includes a removable, reversible table top 14 which is received within a recess 15 with a surrounding ledge 21. The ledge 21 is actually formed from the topmost portions of the side supports 2 and 3 and the frame members 5 and 6. Beneath the reversible table top 14 is a further, recessed play surface 22. The reversible table top 14 has a plurality of modular building block connectors 23 on one side thereof while the reverse side of the table top 14 is smooth.

A pair of toy storage tubs 24 and 25 each include a rim 26. Left and right drawer supports 31 and 32, and a combined center drawer support 33 are attached beneath the recessed play surface 22 via a plurality of screws 34. The tubs 24 and 25 act as drawers when the rims 26 are inserted within slots 35, 36, and 37 in the drawer supports 31–33, respectively.

Figure 5:
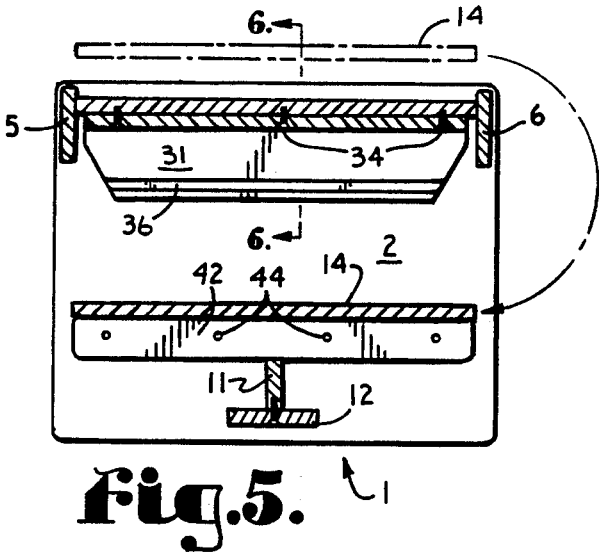
FIG. 5 is a cross-sectional view of the play table, taken along line 5—5 of FIG. 3, and illustrating the reversible table top in phantom lines being removed from the table, and in solid lines placed within the table storage area.

A pair of top braces 39 and 40 are attached to the side supports 2 and 3 via screws 41. The top braces 39 and 40 serve to support the recessed play surface 22. The recessed play surface 22 can be affixed to the braces 39 and 40, or, alternatively, can be merely placed thereon such that the recessed play surface 22 is removable as well. An additional pair of braces 42 and 43 are also attached to the side supports 2 and 3 via screws 44, just above the frame member 11. The braces 42 and 43 serve to hold the reversible table top 14 so that it can be conveniently stored after removal, as shown in FIG. 5.

Figure 6:
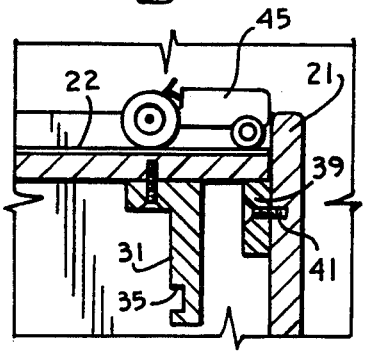
FIG. 6 is an enlarged, fragmentary, cross-sectional view of the play table, taken along line 6—6 of FIG. 5, and illustrating the reversible table top removed to leave the recessed play surface exposed within a surrounding ledge.
Figure 7:
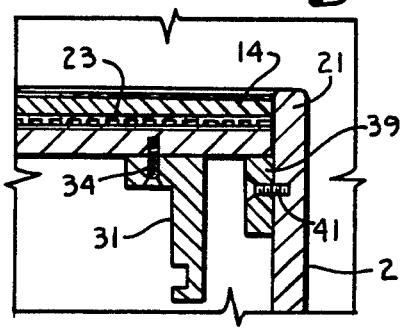
FIG. 7 is an enlarged, fragmentary, cross-sectional view of the play table, taken along line 6—6 of FIG. 5, and illustrating the reversible table top replaced on top of the recessed play surface and within the surrounding ledge.

Referring to FIG. 6, the table 1 is illustrated with the table top 14 removed. A child's toy tractor 45 is shown operating on the recessed play surface 22. As illustrated, the ledge 21 prevents the tractor 45 from rolling off of the surface 22. This feature is particularly desirable for very young children with minimal coordination. It is also very useful for assembling puzzles or playing games which include many small pieces.

Referring to FIG. 1, the table top 14 can be divided into a number of surface areas, such as areas **14*a*–14*d***, with each surface area a different color. This arrangement, particularly with bright contrasting colors, can add visual variety and stimulation for small children.

Figure 9:
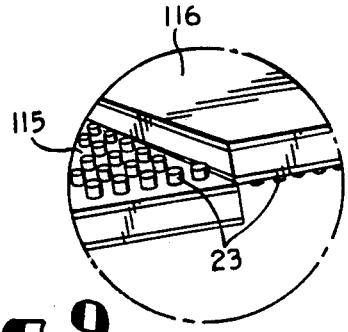
FIG. 9 is a fragmentary, enlarged portion of the reversible table top area labeled 9 in FIG. 8, showing a split table top with modular building block interlocking components facing upward on one half and a smooth surface facing upward on the other half.
Figure 8:
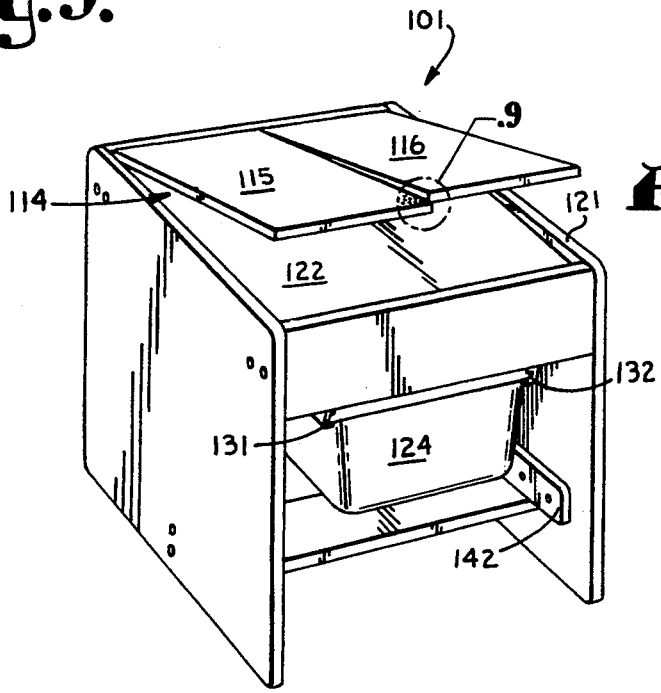
FIG. 8 is a perspective view of an alternative embodiment of the versatile children's play table in accordance with the present invention, with a split removable and reversible table top and a single toy storage drawer.

Referring to FIGS. 8 and 9, an alternative embodiment of the child's play table is generally indicated at 101 in FIG. 8. The table 101 is otherwise substantially the same as the table 1 of FIG. 1, and, accordingly, many similar parts appearing in FIGS. 1–7 have not been renumbered in FIGS. 8 and 9.

The table 101 includes a reversible table top 114, which is comprised of two split halves 115 and 116. Each of the halves 115 and 116 has the modular building block connectors 23 on one side and a smooth surface on the other side. Referring to FIG. 9, each table top half 115 and 116 can be independently reversed to expose either the building block surface or the smooth surface. By exposing the smooth side of table top half 116 while exposing the building block connectors of the half 115, building blocks can be assembled on the table top half 115 by one child while, for example, another child draws or colors on the half 116. As in the table 1, a recessed smooth playing surface 122 is provided beneath the table top 114. For additional variety, one of the table top halves, such as the half 116, can be removed, leaving the other half 115 in place on the recessed surface 122. In this configuration, one child can play with rolling toys or small play pieces on the exposed portion of the recessed play surface 122 which would normally be covered by the half 116, while another child uses modular blocks on a modular side, or draws on the smooth side of the remaining table top half 115. Of course, the remaining reversible table top half 115 acts as an extension of the ledge 121 for the recessed half of the surface 122 which would normally be under the half 116.

A single large tub 124 is provided for toy storage. The tub 124 operates as a drawer in drawer supports 131 and 132 or, alternatively, sits on one or more of the table top halves 115 and 116 stored on supports 142. The table 101 can be designed such that the combined table top 114 is basically square such that the halves 115 and 116, when turned ninety degrees, rest on the supports 142.

It is to be understood that while certain forms of the present invention have been illustrated and described herein, it is not to be limited to the specific forms or arrangement of parts described and shown.

What is claimed and desired to be secured by Letters Patent is as follows:

1. A child's play table, comprising:

(a) a two-sided removable and reversible table top with disparate play surfaces on the two sides thereof with one of said play surfaces comprising a modular building block interconnect surface;

(b) a recessed play surface;

(c) support means comprising a plurality of side panels which extend upward past said recessed play surface to form a ledge at least partially surrounding said recessed play surface, said table top being adapted to fit within said ledge formed by said side panels;
(d) a storage means positioned beneath said recessed play surface; and
(e) a pair of storage drawers positioned within said support means and between said recessed play surface and said storage means.

2. A table as in claim 1, wherein:
(a) said storage drawers are adapted to operate within a plurality of drawer supports attached beneath said recessed surface.

3. A table as in claim 1, wherein:
(a) said recessed surface is also removable.

4. A table as in claim 1, wherein:
(a) said storage means comprises a pair of braces attached to said side panels.

5. A child's play table, comprising:
(a) a support means;
(b) a two-sided removable and reversible table top with disparate play surfaces on the two sides thereof, said table top comprising a plurality of separate sections with each said section being independently removable and reversible;
(c) a recessed play surface;
(d) said support means comprising a plurality of side panels which extend upward past said recessed play surface to form a ledge at least partially surrounding said recessed play surface;
(e) storage means positioned beneath said recessed play surface for storing said table top when removed; and
(f) a storage drawer positioned within said support means and between said recessed play surface and said storage means.

6. A table as in claim 5, wherein:
(a) said reversible table top is adapted to fit within said ledge formed by said side panels.

7. A table as in claim 5, wherein:
(a) said disparate play surfaces comprise a modular building block interconnect surface on one of said table top sides.

8. A table as in claim 5, wherein
(a) said storage drawer is adapted to operate within a plurality of drawer supports attached beneath said recessed surface.

9. A table as in claim 5, wherein:
(a) said recessed surface is also removable.

10. A child's play table, comprising:
(a) a two-sided removable and reversible table top with disparate play surfaces on the two sides thereof, one of said play surfaces comprising a modular building block interconnection system;
(b) a recessed play surface;
(c) a support means comprising a ledge at least partially surrounding said recessed play surface, said reversible table top fitting within said ledge such that, when said reversible table top is positioned on said table, the upward facing play surface lies substantially flush with a top surface of said ledge;
(d) a storage means within said support means for storing said table top when removed; and
(e) a storage drawer positioned within said support means.

11. A table as in claim 10, wherein:
(a) said recessed surface is also removable.

12. A table as in claim 10, wherein:
(a) said reversible table top is adapted to fit within said ledge formed by said side panels.

13. A child's play table, comprising:
(a) a two-sided removable and reversible, table top with a modular building block play surface on one side and a different play surface on the reverse side thereof;
(b) a recessed play surface;
(c) a support means comprising a plurality of side panels which extend upward past said recessed play surface to form a ledge at least partially surrounding said recessed play surface;
(d) a storage means comprising a pair of braces attached to said side panels within said support means and beneath said recessed play surface, for storing said table top when removed;
(e) said reversible table top being adapted to fit within said ledge formed by said side panels; and
(f) at least one storage drawer positioned within said support means and between said recessed play surface and said storage means, said storage drawer being adapted to operate within a plurality of drawer supports attached beneath said recessed play surface.

14. A table as in claim 13, wherein:
(a) there are a pair of said storage drawers positioned within said support means.

15. A table as in claim 13, wherein:
(a) said table top comprises a plurality of separate sections with each said section being independently removable and reversible.

16. A table as in claim 15, wherein:
(a) each said separate section of said table top includes a modular building block surface on one side and a different play surface on the reverse side thereof.

17. A table as in claim 13, wherein:
(a) said storage drawer is removable and accessible from at least two different sides of said play table.

18. A child's play table, comprising:
(a) a support means;
(b) a two-sided removable and reversible table top with disparate play surfaces on the two sides thereof;
(c) said support means comprising a plurality of side panels which extend upward to form a perimeter ledge;
(d) said removable and reversible table top fitting within said perimeter ledge with a selected one of said play surfaces facing upward and at least one of said disparate play surfaces comprising a modular building block interconnect surface;
(e) a removable storage drawer means selectively positioned within said support means for storing game pieces, building blocks or the like for play on said table; and
(f) a storage means positioned within said support means for storage of said removable and reversible table top.

19. A table as in claim 18, wherein:
(a) said removable storage drawer is accessible from at least two different sides of said play table.

20. A table as in claim 18, wherein:
(a) said table top comprises a plurality of separate sections with each said section being independently removable and reversible.

21. A child's play table, comprising:

(a) a two-sided removable and reversible table top with disparate play surfaces on the two sides thereof with one of said play surfaces comprising a modular building block interconnect surface;

(b) a recessed play surface;

(c) support means comprising a plurality of side panels which extend upward past said recessed play surface to form a ledge at least partially surrounding said recessed play surface, said table top being adapted to fit within said ledge formed by said side panels;

(d) a storage means positioned beneath said recessed play surface; and (e) a storage drawer positioned within said support and between said recessed play surface and said storage means.

22. A child's play table, comprising:

(a) a two-sided removable and reversible table top with disparate play surfaces on the two sides thereof;

(b) a recessed play surface;

(c) a support means comprising a plurality of side panels which extend upward past said recessed play surface to form a ledge at least partially surrounding said recessed play surface;

(d) storage means positioned beneath said recessed play surface for storing said table top when removed; and (e) a toy storage means positioned within said support means.

23. A table as in claim 22, wherein:

(a) said toy storage means is a removable storage drawer.

* * * * *